US006651288B1

(12) United States Patent
Hackett

(10) Patent No.: US 6,651,288 B1
(45) Date of Patent: Nov. 25, 2003

(54) SHOE SOLE CLEANER BOX

(76) Inventor: Margie Ilene Hackett, 13842 N. Newcastle Dr., Sun City, AZ (US) 85351-2540

( * ) Notice: Subject to any disclaimer, the term of this patent is extended or adjusted under 35 U.S.C. 154(b) by 0 days.

(21) Appl. No.: 10/349,333

(22) Filed: Jan. 21, 2003

(51) Int. Cl.[7] ..... A47L 23/22

(52) U.S. Cl. ..... 15/104.92; 15/215; 15/217; 15/161; D32/14.1

(58) Field of Search ..... 15/215, 216, 217, 15/104.92, 161, 112, 210.1, 237, 238, 160; 4/597, 606, 607, 610, 622; D32/14.1

(56) References Cited

U.S. PATENT DOCUMENTS

| | | | | | |
|---|---|---|---|---|---|
| 899,515 | A | * | 9/1908 | De Lapp | 15/112 |
| 1,022,950 | A | * | 4/1912 | Jones | 280/164.2 |
| 1,136,528 | A | * | 4/1915 | Higley | 15/112 |
| 2,591,331 | A | * | 4/1952 | Baumbach | 15/160 |
| 2,809,406 | A | * | 10/1957 | Walter | 422/292 |
| 3,064,296 | A | * | 11/1962 | Lidke | 15/185 |
| 3,696,459 | A | * | 10/1972 | Kucera et al. | 15/104.92 |
| 4,866,805 | A | * | 9/1989 | Oden et al. | 15/104.92 |
| D355,734 | S | * | 2/1995 | Goble | D32/14.1 |
| 5,724,695 | A | * | 3/1998 | Galizia | 15/160 |
| 5,996,160 | A | * | 12/1999 | Pruitt | 15/104.92 |
| 6,146,588 | A | * | 11/2000 | Deighton | 422/28 |
| 6,243,907 | B1 | * | 6/2001 | Wagner | 15/112 |

* cited by examiner

*Primary Examiner*—Gary K. Graham

(57) ABSTRACT

A simple, fast, and effective sole cleaning and drying device mainly for removing the dark residue that clings to shoe and boot soles after walking and playing on some types of asphalt paving. This box apparatus can be used for various types and sizes of shoes, allowing people to clean and dry both soles in just a few minutes without having to remove their shoes. The device contains high pile, thick tufted carpet pieces on contiguous sturdy bases that serve as the cleaner and dryer elements, working well on a variety of sole indentations. Used with liquid cleaner and a little water, this arrangement allows fast and easy procedures for effectively cleaning shoe and boot soles. A simple attachment to the box holds the lid up while the soles are being cleaned, then closes for better appearance and security.

3 Claims, 4 Drawing Sheets

SHOE SOLE CLEANER BOX

CROSS-REFERENCE TO RELATED APPLICATIONS

Not Applicable

STATEMENT REGARDING FEDERALLY SPONSORED RESEARCH

Not Applicable

REFERENCE TO SEQUENCE LISTING, A TABLE, ECT.

Not Applicable

BACKGROUND OF THE INVENTION

This invention is a simple, fast, effective, and economical shoe sole cleaning and drying apparatus for various sizes and types of shoes. It is used especially to remove the gray-black residue that stays on soles after walking or playing on asphalt or any other paving material that exudes such dark residue.

Over the years this has become more and more a pervasive and ongoing problem in at least some of the desert parts of the South-west. In a large metropolitan area, including most of the suburbs and even some of the smaller towns around, the problem is often mentioned because it is so common, yet unpleasant to remedy.

Some wealthier areas, as well as government entities, seem to use a better grade of asphalt or they use concrete. Whereas, many privately-owned parking lots, driveways, playgrounds, and streets, which have grown along with the population, seem to be paved and repaved with dark material that clings stubbornly to shoe soles. The hot and dry climate may be a contributing factor.

So, as men, women, and children return home after walking in super market, drug store, church or other parking lots, or on some streets, alleys, and driveways, or playgrounds and outdoor sport surfaces, they arrive with nearly black shoe soles.

Thus, for many people, this is an almost daily problem. They do not have to cope with sand, mud, or other debris on their shoe or boot soles but with the dark dust and residue that tracks into homes to soil carpet, rugs, tile, and upholstered furniture.

Some people try to cope by removing their shoes before they enter the house. Then they have to decide whether to leave them outside, carry them in and wash the soles in a sink, or throw them in a washing machine every day. Understandably, none of these measures is very popular.

Even if people wanted to take off their shoes with the dirtied soles and carry them to a sink to wash them every time they came home, few would find it a happy solution because:

1. the sink method involves having to remove the shoes before entering one's home;
2. cleaning the soles by hand is an unpleasant, dirty, and germ-spreading job;
3. the black comes off on sponges, cleaning cloths, sinks, etc., so then one has all of them to wash;
4. it is difficult to adequately remove the grime by hand, especially from the numerous indentations of various shapes and kinds that are found in walking and hiking shoes, tennis and other athletic shoes.

Overall, women especially have a difficult time keeping the carpet and furniture clean, with no acceptable solution in sight.

Numerous shoe sole cleaning devices have been invented over the years. However, some of them seem to be too specialized or too complicated and expensive to make for the above-mentioned problem. Also, none of them seems to be available in the local marketplace, and one wonders why, unless they are too expensive or specialized to make for the general public.

Some of the prior art is aimed at special types of shoes, i.e., an athletic shoe cleaner in U.S. Pat. No. 4,823,425 to Bragga (1989). This device "is applied to a person's footwear or wrist . . . to dislodge large particles." This would be too specialized for the residue problem.

Another specialization is found in U.S. Pat. No. 6,128,801 to Adzick, et al. (2000) that attaches to the shoe or is built into the shoe and is mostly for athletic shoes but not too practical for general use. Also, there sole cleaners aimed at golf shoes, bowling shoes, etc., and they may meet the needs of these particular types of shoes.

Other inventions seem rather complicated and are large and no doubt expensive—more for commercial use, such as by hotels. Some of these have numerous parts: motors, axles, rollers, sensors, rails, belts, shafts, switches, pulleys, gears, compressed air, sponges, squeegees, bristles, and brushes. U.S. Pat. No. 6,067,688 to West (2000) seems like one of the commercial types that scrapes mud and dirt from soles, and is motorized with many parts.

Some of the prior art does not always clarify what their specific cleaning elements are and do not mention any type of cleaning agent except water. For the black residue mentioned above, a cleaning liquid stronger than water is necessary.

Prior art "box-type" cleaners have motors, brushes, rollers, etc. delineated, but no cleaning agents or absorbable material is mentioned that would remove the black residue. U.S. Pat. No. 5,950,269 to Openshaw, et al. (1999) has brushes, scrapers, a motor and more. The device is aimed at cleaning off mud, but only water is mentioned as a cleaning agent.

U.S. Pat. No. 6,219,873 B1 to Kuechel (2001) appears complex and multi-faceted with belts, a receptacle, shaft element, slide-rail guides, rollers, axles, bristles, and with "other additions possible." This seems like a rather complex and expensive device. Also, the cleaning elements are not adequately described, except for the mention of bristles. It is stated that "the cleaning elements can be made of any suitable material . . . preferably of plastic or organic tissue . . . " This is vague as to their size, texture, and absorbency. Also, there is no mention of a cleaning agent that would remove any special kinds of residue, such as the one previously mentioned.

Thus, most of the prior art inventions seem more specialized, complicated, automated, and expensive to make for the simple, yet frequent and necessary removal of the dark residue described above.

BRIEF SUMMARY OF THE INVENTION

The present invention is an easy-to-use, fast, efficient, and inexpensive device that solves at least one major sole-cleaning problem that is ongoing, unpleasant, widespread—and with no current solution in sight.

Although this invention is simple, it brings together just the right combination of housing, cleaning/drying elements, and cleaning agents to quickly and easily remove the dark residue from a wide variety of shoe sole sizes and types.

To solve this task in an acceptable manner, several objects and advantages of the present invention are:

a) to provide a cleaner and dryer box that could accommodate various types and sizes of shoes and boots worn by men, women, and older children;

b) to provide for soles of varied composition and those shoes with smooth soles or with different kinds of indentations;

c) to provide said apparatus that is not complex, has very few moving parts, and does not require a source of electrical power;

d) to provide a sturdy framework that could withstand everyday use, if necessary, by various individuals;

e) to provide an apparatus that will be compact, appear nice, and yet be practical and affordable for most people;

f) to provide a device that would be fast and easy to use, or some people might—and actually have—skipped cleaning their soles, only to soil both carpet and furniture in a short time;

g) to provide a cleaning/drying device for soles so that shoes do not have to be removed before entering a home;

h) to provide an apparatus that would be portable enough to move when necessary or desirable;

i) to provide a device that can be easily used and maintained without trepidation;

j) to provide sole cleaning elements that can be cleaned and/or replaced when desired at a low cost;

k) to provide an apparatus that is inexpensive to manufacture;

l) to provide real assistance to homemakers by helping to keep their homes clean from dark marks on carpet/rugs, tile floors, and upholstered furniture.

Advantages of My Invention over Prior Art for Residue Removal:

Some of the prior art seems to lack simplicity and concentrates more on numerous parts and automation. Yet, some people—perhaps prospective users of sole cleaners—tend to shun or ignore what looks complicated, or they are easily intimidated by something too automated. They do not want to spend much time trying to figure out how something works or what seem like complex instructions. Also, some people may want to—or need to—put their sole cleaners in places not close to a power source.

The cleaning elements and agents are not clear in some of the prior art reviewed. They may mention water, brushes, bristles, self-stiffening cleaning sheets, or moisture-absorbent material. However, it is the size, composition, and density of the cleaning element, i.e., the high pile, thick tufted carpet piece that is needed to remove paving residue from all of the various grooves on shoe soles. Along with that is a cleaning agent, besides water, such as orange cleaner to wet the dark residue so that it will come off on the cleaner and dryer elements in my invention. The elements are described in the "Description" sections following.

Obviously, the orange cleaner is not part of the invention, but it, or some similar cleaner, needs to be mentioned in connection with the residue problem.

For the main purpose intended, as stated above, my invention has fewer parts than most of the prior art and yet is still quite effective and more affordable than the more complicated devices.

A great deal of the prior art does not seem to be available in the market place. So, if not in wide use, one wonders if it is too expensive to make, too narrow in scope, or just not available in some parts of the country. The invention discussed herein could be available for widespread use in appropriate areas, because it is economical and simple to operate.

Because this problem—the dark residue on shoe soles—is so widespread in some places, it involves many, many homes in every socioeconomic level. There is, then, a need for all of these homes to have their own sole cleaning device to alleviate the problem.

Thus, my invention would seem to lend itself to commercial success since there appears to be nothing like it that is as inexpensive to make, yet fast and simple to use for the purpose stated.

This invention is new in its simplicity. It omits numerous elements in the prior art—motors, switches, belts, gears, rails, etc.—without loss of capability for the problem mentioned. It also provides the advantages of speed and simplicity that are not suggested in previous inventions.

REFERENCE NUMERALS IN DRAWINGS

| | | | |
|---|---|---|---|
| 8 | handle | 10 | box top (lid) |
| 12 | rear bottom board | 14 | hinges |
| 16 | decorative decal | 18 | cleaner element |
| 20 | dryer element | 22 | low wooden frame |
| 24 | rubber feet/suction cups | 26 | short chain to hold top up |
| 28 | support post | 30 | cross bar to hold chain |
| 32 | cleaner base board | 34 | dryer base board |
| 36 | wooden slats to hold shelf | 38 | shelf support angles |
| 40 | shelf | 42 | hook on shelf bottom |
| 44 | long chain on door handle | 46 | loop in chain |
| 48 | framework pieces | 50 | smooth dowels for support |

DETAILED DESCRIPTION OF THE INVENTION

Figure 1:
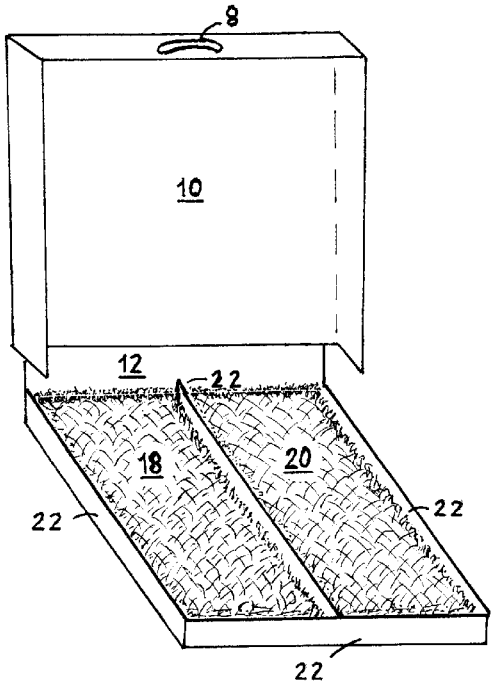
FIG. 1 shows the overall inside appearance of the Sole Cleaner Box in its preferred embodiment.
Figure 2A:
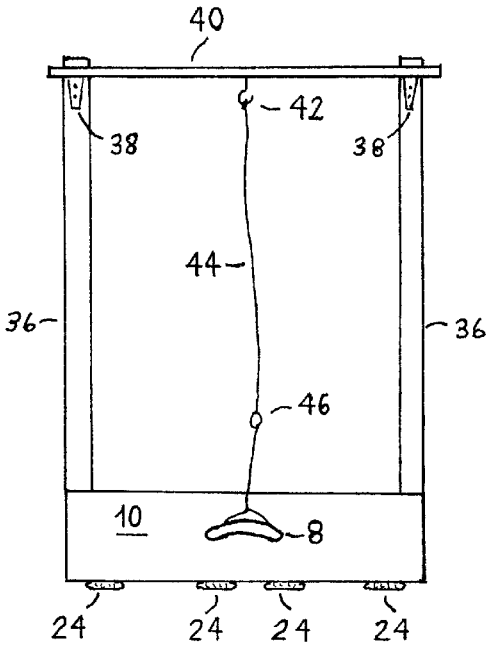
FIG. 2A shows the same cleaner box but with optional attachments—a shelf, hook, and a pull chain or cord.
Figure 2B:
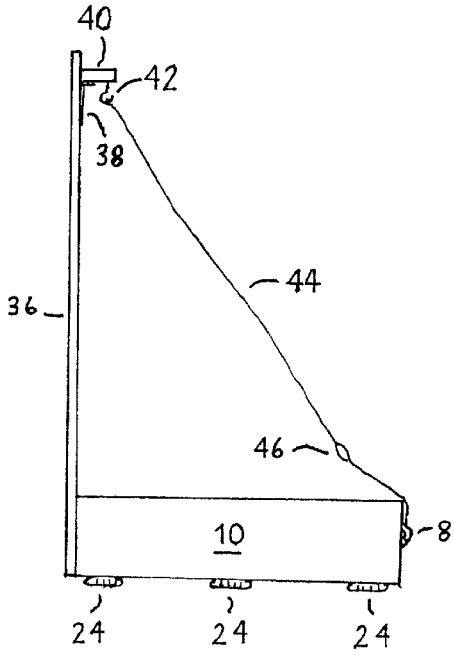
FIG. 2B shows a side view of FIG. 2A.
Figure 3:
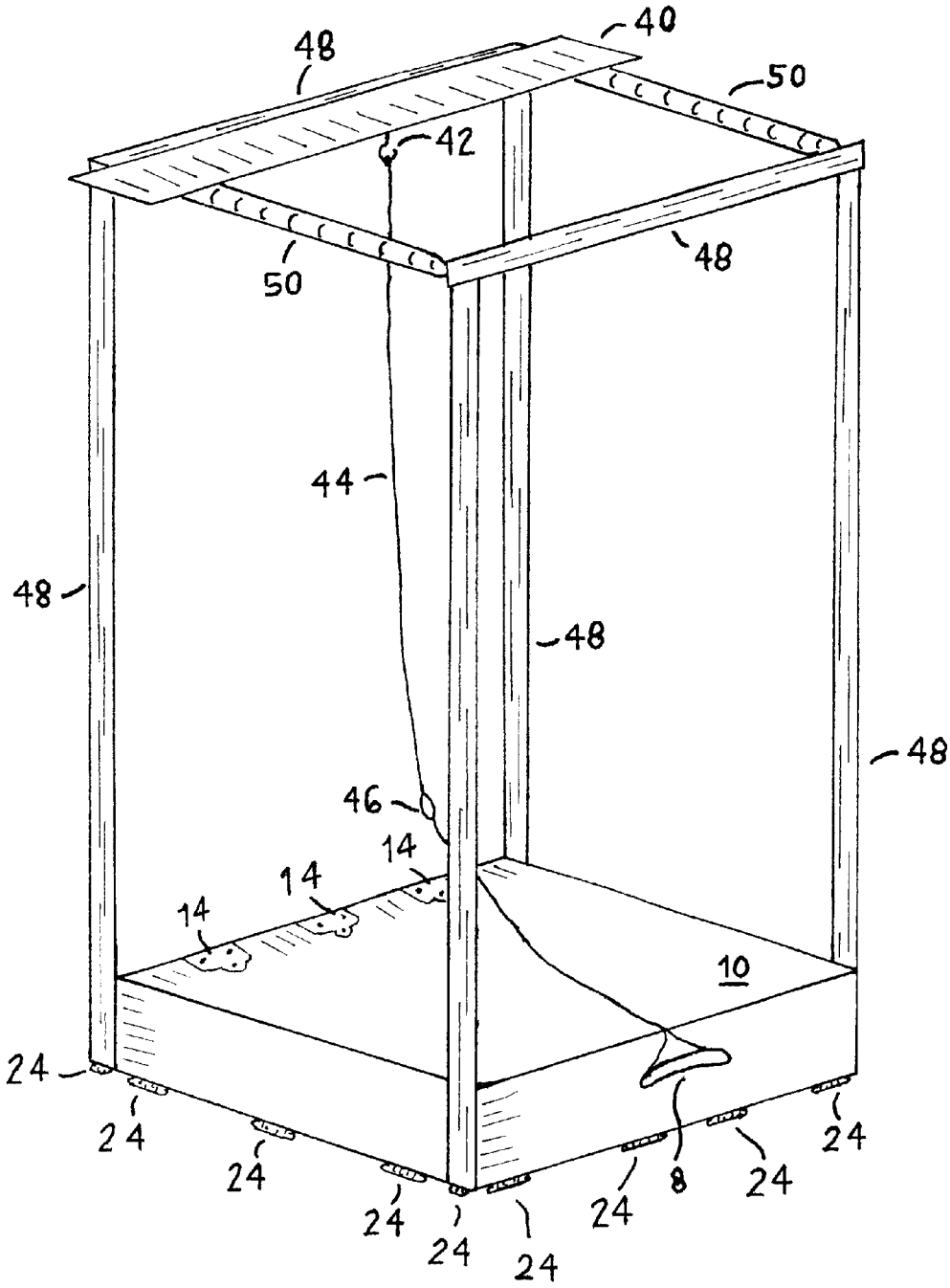
FIG. 3 shows the same cleaner box, but with a taller support framework for a shelf, a pull chain, and a place the user can lean on, if desired.

A preferred embodiment of the shoe sole cleaner and dryer box is illustrated in FIGS. 1 to 3. The top and bottom of the box are constructed separately, so that they can be hinged together later.

The bottom is made first of two rather thick plywood bases 32 and 34 for the cleaner 18 and dryer 20 elements. The bases are rectangular—wide enough and long enough to accommodate most common shoe sizes, and allowing for some movement of the shoes from side to side and forward and backward during the cleaning and drying process.

Figure 1A:
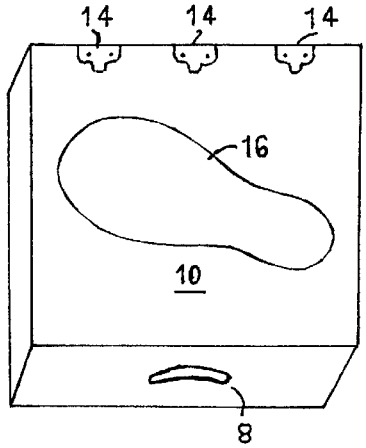
FIG. 1A shows the top or lid of the box in detail.
Figure 1B:
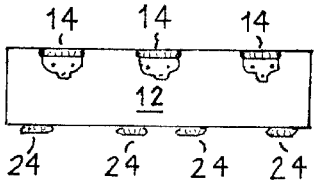
FIG. 1B shows the rear of the box with hinges at the top and rubber feet or suction cups on the bottom.
Figure 1C:
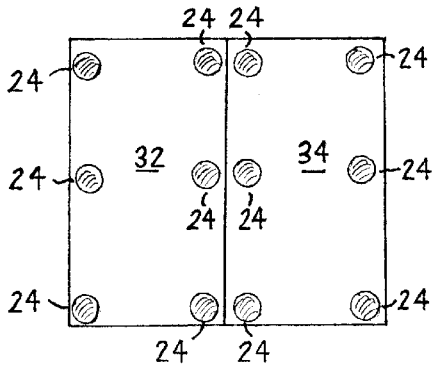
FIG. 1C shows the bottom view of the box with an array of rubber feet or suction cups to aid stability.
Figure 1D:
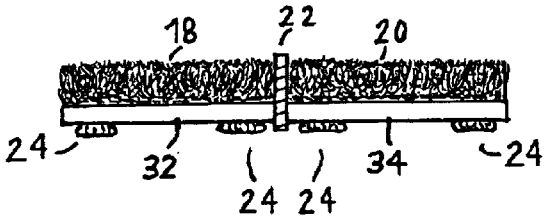
FIG. 1D shows a front view of the cleaner and dryer elements on wooden bases before the frame is added.

The bases are sanded then painted with two coats of paint. A thin strip of wood 22 is put between the long sides of each base and glued to each base side. Now the bottom is all in one piece. Several rubber feet or small suction cups 24 are attached to the bottom to keep it in place when in use. See FIG. 1C.

Since the dark residue has dirtied so many carpets in people's homes, it stands to reason that it might make the best cleaning element—and it does seem so. A piece of high pile, thick tufted carpet, the same size as the base is placed on top of each base, becoming the cleaner element 18 on the left and the dryer element 20 to its right. It is better not to glue the carpet pieces in place, as they may have to be cleaned or replaced when badly soiled.

However, a small frame 22 is made of thin wood around the front edge and both sides of the bases so that the carpet pieces 18 and 20 will be held in place when in use. They are separated by the thin strip of wood 22. See FIG. 1.

The back frame 12 of the bottom will be higher than the sides and front frames, as it needs to be high enough to be hinged 14 to the top of the box 10. See FIGS. 1A and 1B.

The top or lid 10 is made of four pieces of wood glued together, and will be at least one inch larger around than the circumference of the bottom so that it will fit down over it easily. The purpose of the lid 10 is explained later.

Although the "asphalt problem" is prevalent in the Southwest where there are areas that have very little rainfall, the box is painted two coats to keep out the elements and to improve its appearance. Thus, after the lid 10 is together, it is painted with a primer and finish coat. A decorative decal 16, perhaps, can be affixed to the lid 10. A handle 8 is attached to the front of the lid 10. The top back of the lid 10 is fastened with hinges 14 to the top rear bottom 12 of the box. See FIGS. 1A and 1B.

Once the box is ready to use, there needs to be some simple way to keep the lid 10 up after it is opened. A single support post 28 is attached to the bottom middle rear 12 of the box. See FIG. 1E. The post 28 is slightly higher than the box lid 10 will be when fully opened, and it has a small crossbar 30 affixed to it. A short chain 26 has been attached to the box handle 8 and is used to lift the lid 10 straight up, then the chain 26 is looped over the top of post 28, and the crossbar 30 holds the chain up so that the lid 10 stays open when the cleaner is being used. After use, the chain 26 is lifted to let the top 10 down, closing the box.

If kept closed when not in use, it can: help keep the cleaner element 18 from drying out; it can keep dirt, etc. from getting onto the elements; and it can keep out small children, as well as insects and small varmints (the latter being common in the desert Southwest. To keep small children from opening the box, the chain 26 can be looped over a small hook or nail underneath the front of the box, if desired.

Before discussing the operation of the cleaner box, mention needs to be made of FIGS. 2 and 3. These are not considered alternate embodiments of the invention because the cleaning apparatus, i.e., the box, is the same as in FIGS. 1–1E.

Figure 1E:
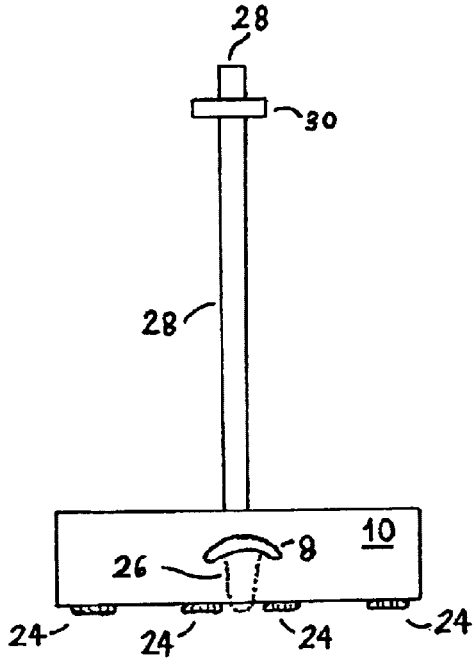
FIG. 1E shows the box closed with a slat and crossbar attached to the rear and a short chain added to the handle.

FIGS. 2 and 3 are simply showing two separate additions or options that might be desirable to some people. Their choice would involve:

1. the cleaner/dryer box as described in FIGS. 1–1E. This is the basic box and would be the least expensive version. It would be acceptable to those users who do not mind stooping or bending over to open the box.
2. FIGS. 2A and 2B depicting a rather simple attachment 36 for those users who want a shelf 40 and the pull chain opener 44 for the top 10. This would add some to the cost.
3. The framework 48 addition described in FIG. 3 would cost additionally but would be beneficial for those people with impaired agility or some types of disabilities. This addition would provide the shelf 40, the chain pull 44, and especially the framework 48 to lean on, if needed.

The addition shown in FIGS. 2A and 2B involves attaching two poles 36 of wood to the back 12 of the box and affixing a shelf 40 between them; see FIG. 2A. A shelf bracket 38 would be placed on each pole to support the shelf 40. A sufficiently long chain 44 can be lifted to pull the top 10 up, and a loop 46 in the chain 44 is placed over the hook 42 to hold the top 10 there when the cleaner is being used.

The addition in FIG. 3 involves a framework 48 that fits around the cleaner box and could be fastened to it at the bottom. The framework 48 is made of wooden slats or poles as seen in FIG. 3.

The two top pieces 50 on either side are smooth dowels for hands to rest on. The shelf 40 is affixed to the top of the dowels 50. Again, a hook 42 hangs from the shelf 40 bottom to hold the pull chain 44 for opening the top 10 of the box. The framework 48 could be shaped differently or made of other material.

The sole cleaner described in FIGS. 1–3 is not intended for use on shoes or boots that have mud, manure, or other heavy debris on them; not is it appropriate for golf shoes or other cleated types. This invention, as stated, is mainly for removing the dark residue.

People do not have to take their shoes off to clean the soles. It should take only two or three minutes to effectively clean both soles. This device can be placed near any door or entryway, on a porch, in the garage or carport—wherever people enter the home.

How to Use the Invention

To operate the basic box model, simply lift the handle 8 and place the chain 26 over the pole 28 to rest on the crossbar 30, holding the box open for use. The first time one uses the device, one should spray a fine mist of orange cleaner, or something similar, over the entire top of the cleaner carpet element 18. Then thin it a bit with a little fine spray of water over it. It is best to use a fine spray from both bottles rather than a stream of liquid, because the latter usually gets the carpet too wet. After the first time or two of use, a person will know just about how damp to keep the surface of the cleaner element 18.

Now, start by putting the right foot onto the cleaner element 18. Press the foot down somewhat, and move it to the left, then to the right several times, or simply twirl the toe left and right, then the heel. Next, move the foot forward and backward a few times, also.

Remove the foot from the cleaner element 18 and immediately put it on the right carpet piece 20 (which should be dry) and, while pressing down, move it as before—side to side, and then forward and backward several times. Next, lift the foot slightly and rub the outer edge of the shoe on the carpet, all of the way around it, to dry the edge of the sole.

Repeat the above process with the left foot. Both shoe soles should be clean enough to enter the home without leaving black marks on anything. Obviously, the pressure of putting one's foot down on the carpet pieces 18 and 20 helps to wash and dry any indentations that are in the shoe soles.

As a person uses the device the first few times, it is advisable to check each sole along the way to see if the steps are producing the desired results. In a short time, it becomes habitually fast and effective.

It is up to the user to keep the soaped cleaner element 18 with just enough moisture—but not too much—to clean the soles. If the orange cleaner dries out too much, spray it with a little water to make it work. Occasionally, some one may have to add more orange cleaner to the box. Again, do not make it too "soupy" or the carpet will be too wet, and the shoes will slide too much to clean well. Just barely damp keeps the carpet ridges firm enough to clean any indentations in the soles.

It is recommended, for convenience sake, that the cleaner liquid and water be kept in individual eight-ounce spray bottles. These will last for quite some time, depending on frequency of use. When one needs more orange cleaner, an inexpensive 32-ounce bottle of it can be purchased for very little, and then one can refill the smaller, handier plastic spray bottle with it.

The orange cleaner was selected not only for its cleaning ability, but also because it has no strong chemical odor to offend allergy sufferers, and it leaves no smeary residue on the soles Occasionally, maybe after a month, depending on how much use the carpet pieces get, someone may have to clean both of them. Simply remove the pieces from their bases and clean them with carpet foam or something similar, or clean both pieces with just plain white vinegar and an old piece of terry cloth. Dry both pieces before returning to their bases.

If no one wants to clean the carpet pieces, they can be disposed of, and replacement pieces purchased periodically for little cost.

The only difference in operation for the addition in FIGS. 2A and 2B is that the user takes the chain 44 when on its hook 42 and lifts the lid 10 up with it so that the loop 46 fits over the hook 42 to hold the box open while the soles are cleaned. The shelf 40 can be used to store the cleaner liquid and water bottles. When both soles have been cleaned and dried, the loop 44 is released from the hook 42, allowing the box lid 10 to drop down over the bottom. Then the upper chain 44 end fits over the hook 42 once again.

This same procedure is used for the framework addition in FIG. 3, where the chain, hook, and shelf are similarly located but higher up. The chain 44 in FIG. 3 is necessarily a bit longer than in FIGS. 1 and 2.

Accordingly, the reader will see that this is a very simple apparatus for cleaning shoe soles. Its main advantages are its simplicity, its effectiveness, and its economy. There are no metal or moving parts to damage shoes or to need repair. There is no need for electricity, and shoe soles come clean with little effort by using the device as suggested.

The description is not meant to be too limiting. The size of the box and elements could be varied somewhat, and there could be other construction materials and hardware items that would suffice.

The box cleaner can be used fast and effectively, but it was made intentionally as simple and inexpensive as possible because of the need for this type of cleaner by many households.

What is claimed is:

1. A shoe sole cleaning and drying apparatus for removing dust and dark residue from shoe soles, said apparatus comprising:

a box shaped housing including a bottom portion and a lid;

said bottom portion having a front, rear, sides and a bottom, said bottom having feet attached thereto extending downwardly for supporting said bottom portion on a surface;

said lid having a handle thereon and being hingedly coupled with said rear of the bottom portion for movement between an opened and closed position;

cleaner and dryer elements provided removably within said bottom portion;

said elements each comprising high pile, thick tufted carpet pieces, wherein said cleaner element is provided with a liquid cleaning agent effective for removing asphalt residue;

a pole attached to said rear and extending upwardly;

said pole having a cross bar thereon at a distal end of said pole with respect to said bottom;

a chain attached to said handle forming a loop; and wherein in the opened position, the loop can be placed over the distal end of the pole and engage the cross bar to hold the lid in the open position while the apparatus is being used by a user.

2. A shoe sole cleaning and drying apparatus for removing dust and dark residue from shoe soles, said apparatus comprising:

a box shaped housing including a bottom portion and a lid;

said bottom portion having a front, rear, sides and a bottom, said bottom having feet attached thereto extending downwardly for supporting said bottom portion on a surface;

said lid having a handle thereon and being hingedly coupled with said rear of the bottom portion for movement between an opened and closed position;

cleaner and dryer elements provided removably within said bottom portion;

said elements each comprising high pile, thick tufted carpet pieces, wherein said cleaner clement is provided with a liquid cleaning agent effective for removing asphalt residue;

a pair of wood strips attached to said rear and extending upwardly;

said strips supporting a shelf at a distal end thereof with respect to said bottom, said shelf having a hook thereon;

an elongated chain attached at one end to said handle and at another end to said shelf, said chain having a loop thereon; and wherein in the opened position, the loop can be placed on the hook to hold the lid in the open position while the apparatus is being used by a user.

3. A shoe sole cleaning and drying apparatus for removing dust and dark residue from shoe soles, said apparatus comprising:

a box shaped housing including a bottom portion and a lid;

said bottom portion having a front, rear, sides and a bottom, said bottom having feet attached thereto extending downwardly for supporting said bottom portion on a surface;

said lid having a handle thereon and being hingedly coupled with said rear of the bottom portion for movement between an opened and closed position;

cleaner and dryer elements provided removably within said bottom portion;

said elements each comprising high pile, thick tufted carpet pieces, wherein said cleaner element is provided with a liquid cleaning agent effective for removing asphalt residue;

an open framed structure fit over and around the housing and extending upwardly therefrom, said structure defining a pair of hand holds, said structure supporting a shelf at a distal end thereof with respect to said bottom, said shelf having a hook thereon;

an elongated chain attached at one end to said handle and at another end to said shelf, said chain having a loop thereon; and wherein in the opened position, the loop can be placed on the hook to hold the lid in the open position while the apparatus is being used by a user.

* * * * *